US005395459A

United States Patent [19]

Pinkerton et al.

[11] Patent Number: 5,395,459

[45] Date of Patent: Mar. 7, 1995

[54] METHOD FOR FORMING SAMARIUM-IRON-NITRIDE MAGNET ALLOYS

[75] Inventors: Frederick E. Pinkerton, Shelby Township, Macomb County; Carlton D. Fuerst, Royal Oak, both of Mich.

[73] Assignee: General Motors Corporation, Detroit, Mich.

[21] Appl. No.: 154,678

[22] Filed: Nov. 18, 1993

Related U.S. Application Data

[63] Continuation of Ser. No. 894,974, Jun. 8, 1992, abandoned.

[51] Int. Cl.[6] ..... H01F 1/02

[52] U.S. Cl. ..... 148/101; 148/122; 148/221

[58] Field of Search ..... 148/101, 122, 207, 221, 148/230; 420/83

[56] References Cited

U.S. PATENT DOCUMENTS 4,496,395 1/1985 Croat ..... 148/301
4,778,542 10/1988 Clemens ..... 148/103

OTHER PUBLICATIONS

J. M. D. Coey et al, J. Magn. Magn. Mat. 87, L251 (1990).
Hong Sun et al, J. Phys. CM2, 6465 (1990).
J. M. D. Coey et al, Paper No. S1.3 at the Sixth International . . . Pittsburgh, Pa. 15213 USA Oct. 1990.
K. Schnitzke et al, Appl. Phys. Lett. 57 (26), 1990, pp. 2853–2855.

*Primary Examiner*—John P. Sheehan
*Attorney, Agent, or Firm*—George A. Grove

[57] ABSTRACT

In a preferred method, a molten alloy of samarium and iron is formed with a proportion of about 1:4 to about 1:9 of samarium to iron. The molten alloy is then quenched in a non-oxidizing environment at a rate sufficient to form a solid crystalline alloy in the form of a thin ribbon. The ribbon is comminuted to form a powder and the powder is nitrided in a gaseous nitrogen atmosphere. Nitriding causes nitrogen to penetrate and occupy interstitial sites in the Sm-Fe alloy, producing a magnetically hard powder with a high coercivity typically 10 kOe, usually greater than 15 kOe and as high as about 20 to about 23 kOe.

12 Claims, 4 Drawing Sheets

METHOD FOR FORMING SAMARIUM-IRON-NITRIDE MAGNET ALLOYS

This is a continuation application of U.S. patent application Ser. No. 07/894,974, filed on Jun. 8, 1992, now abandoned.

FIELD OF THE INVENTION

This invention relates to magnetically hard samarium-iron-nitrogen (Sm-Fe-N) compositions and a method of making such compositions.

BACKGROUND OF THE INVENTION

A rare earth-iron alloy of neodymium-iron with intrinsic room temperature coercivity exceeding 5 kOe was obtained by Croat, U.S. Pat. No. 4,496,395, assigned to the assignee of this application. A samarium-iron alloy having typically about 40 atomic percent samarium was also disclosed.

U.S. Pat. No. 4,969,961 to Pinkerton et al, assigned to the assignee of the present invention, discloses a magnetically hard compound having the approximate formula $SmFe_{10}V_2$ which exhibits an intrinsic room temperature coercivity of about 5 kOe.

Recently, it has been discovered that interstitial nitrides can be prepared from the $R_2Fe_{17}$ series of rare earth-iron alloys, and that nitriding produces an increase in Curie temperatures. $Sm_2Fe_{17}$ is a member of this rare-earth series.

Two different approaches have been reported for magnetically hardening an Sm-Fe precursor. The first is fabrication of a nitrided, magnetically aligned, metal-bonded magnet using Zn or a similar low melting point metal as the binder. The Sm-Fe-N-Zn pellet so produced has an intrinsic room temperature coercivity $H_{ci}$ of about 6 kOe. Higher coercivity has been obtained by mechanical alloying of Sm and Fe, nitriding and then cold pressing or resin bonding.

It is desirable to have an improved, economical method for producing magnetically hard Sm-Fe-N compositions.

SUMMARY OF THE INVENTION

In a preferred method, samarium and iron are each provided in an amount sufficient to produce an atomic proportion of about 1:4 to about 1:9 of samarium to iron (Sm:Fe). The samarium and iron are heated in a non-oxidizing environment to form a molten alloy thereof. Then the molten samarium/iron alloy is quenched in a non-oxidizing environment at a rate sufficient to form a solid crystalline or amorphous alloy. Preferably, a solid crystalline alloy is formed with grains of a size less than about 1000 nm (nanometers), desirably in a range of about 20 nm to about 500 nm, and preferably about 50 nm to about 200 nm.

Preferably, the quenching is accomplished by applying an amount of the molten alloy onto a cooled surface so as to solidify it in the form of a body having a thickness of less than about 200 microns (μm), desirably about 20 microns to about 120 microns and preferably about 30 to about 40 microns.

The solidified body is then comminuted to form particles of the solid crystalline alloy each having a maximum cross-dimension or diameter less than about 45 microns. Preferably, comminuting is conducted for a time sufficient to form particles with a maximum dimension of less than about 25 microns to about 30 microns.

The particles are nitrified in a non-oxidizing, nitrogen containing environment for a time and at a temperature sufficient to cause nitrogen to occupy interstices in the atomic crystal structure of the alloy. Preferably, the step of nitrifying is conducted at a temperature of about 420° C. to about 480° C. for a time of about 4 to about 16 hours. It has been found that gaseous nitrogen at about 5 $lb/in^2$ gage pressure is sufficient to produce a suitable environment for the step of nitrifying. Advantageously, higher pressures are not required.

Preferably, the method further includes annealing the particles prior to nitrifying, and the annealing is conducted at a temperature of about 650° C. to about 750° C. for a time of about 0.1 to about 10 hours in a non-oxidizing environment and preferably in a vacuum. If the particles produced by quenching are amorphous rather than crystalline, the heat treating will also produce the crystalline form having the grain sizes described above.

The method produces magnetically hard Sm-Fe-N with a diffraction pattern that closely resembles $Sm_2Fe_{17}N_x$, where x is 2 or more, and with an intrinsic coercivity of at least about 10,000 Oersteds at room temperature. When the preferred steps of comminuting to 25 to about 30 microns and annealing are conducted, coercivity is at least 20,000 Oersteds.

The method is convenient, economical and is an important improvement for the high volume, mass production manufacturing process which is essential to automotive production.

These and other objects, features and advantages will become apparent from the following description of the preferred embodiments, appended claims and accompanying drawings.

BRIEF DESCRIPTION OF THE DRAWINGS

FIG. 3(*b*) shows x-ray spectra for the powder of FIG. 5(*a*) after nitriding for 4 hours at 475° C. to about 480° C.

FIG. 3(*c*) shows x-ray spectra for a comparative Sm-Fe ingot.

FIG. 5(*b*) shows x-ray spectra for the powder of FIG. 5(*a*) after annealing in a vacuum at about 700° C.

FIG. 5(*c*) shows x-ray spectra for the powder of FIG. 5(*b*) after nitriding for 19 hours at about 470° C. to about 480° C.

DETAILED DESCRIPTION OF THE PREFERRED EMBODIMENTS

Figure 1:
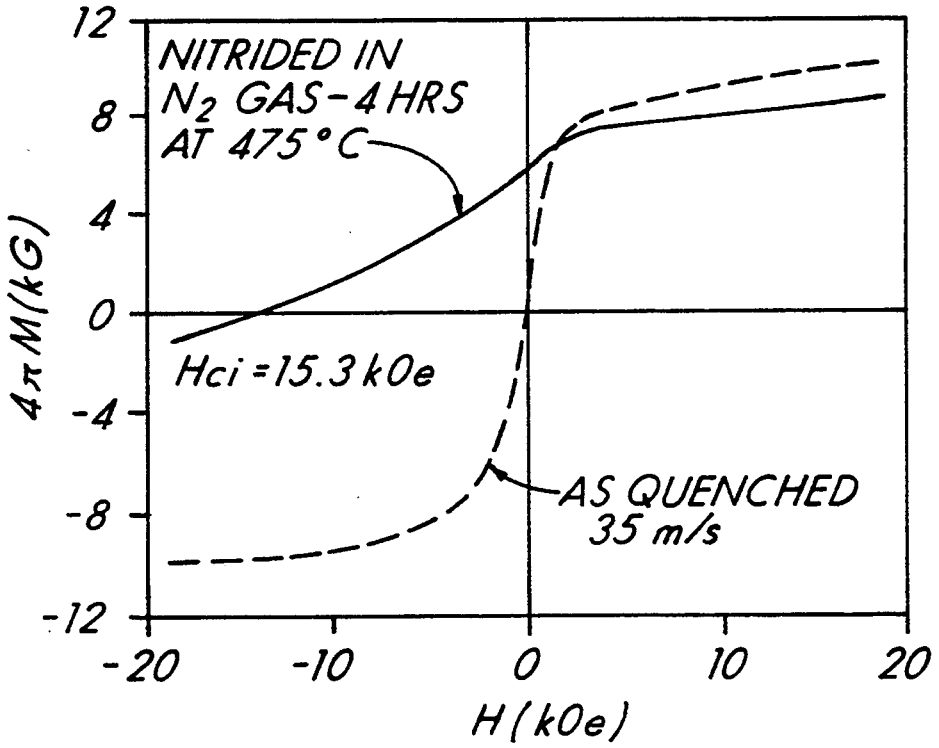
FIG. 1 is a demagnetization curve for Sm-Fe-N, −325 mesh, powder of Example 1.

In a preferred method, a solid thin strip or ribbon of samarium-iron (Sm-Fe) alloy is prepared by melt spinning a molten mixture of Sm and Fe. Then, the ribbon is ball-milled to form a powder and the powder is nitrided in a gaseous nitrogen ($N_2$) atmosphere. Nitriding causes nitrogen to penetrate and occupy interstitial sites in the Sm-Fe alloy, producing a magnetically hard powder with a high coercivity, typically 10 kOe, usually greater than 15 kOe, and as high as about 20 to about 23 kOe. Nitriding the compound profoundly changes its magnetic properties, converting the anisotropy to uniaxial and substantially improving the Curie temperature and the room temperature saturation magnetization $4\pi M_s$.

The desirable magnetic properties were obtained by a method in which samarium and iron starting materials were in amounts sufficient to produce an atomic proportion of about 1:4 to about 1:9 of samarium to iron (Sm:Fe). A preferred nominal starting composition of Sm:Fe was 15:85. Conveniently, this composition was achieved by induction melting ingots of Sm and Fe.

In the following examples, alloy ingots were broken into chunks small enough to fit inside a spin melting tube (crucible or tundish) made of quartz. Ceramic or other suitable refractory materials could be used. Each tube had a small orifice in its bottom through which an alloy could be ejected. The top of the tube was sealed and provided with means for containing pressurized gas in the tube above a molten alloy. A heating coil was disposed around the portion of the tube containing the alloy to be melt spun. When the coil was activated, the chunks of alloy within the tube melted and formed a fluid mass.

In a preferred method, the molten Sm-Fe alloy was ejected from the tube by introducing an inert gas into the space above the molten alloy at a constant positive pressure to eject it through the small orifice at a constant rate. The orifice was located only a short distance from a chill surface on which the molten metal was quenched, that is, rapidly cooled and solidified into ribbon form. The surface was the outer perimeter of a rotating copper quench disk plated with chromium.

The disk was rotated at a constant speed so that the relative velocity between the ejected alloy and the chill surface was substantially constant.

Herein, the disk speed ($V_s$) is the speed in meters per second of a point on the chill surface of the melt-spinner's quench disk as it rotates at a constant rotational velocity. Because the chill disk was much more massive than the alloy ribbon, it acted as an infinitely thick heat sink for the metal that solidified on it. The disk may be cooled by any suitable means to prevent heat build-up during long runs. The terms "melt spinning" or "melt spun" as used herein refer to the process described above as well as any like process which achieves a like result.

The principal limiting factor for the rate of chill of a ribbon of alloy on the relatively cooler disk surface is its thickness. If the ribbon is too thick, the metal most remote from the chill surface will cool too slowly. Preferably, the quenching is accomplished by applying an amount of the molten alloy onto a cool surface so as to solidify the alloy in the form of an alloy ribbon with a crystalline microstructure and a thickness of less than about 200 microns ($\mu$m), desirably about 20 microns to about 120 microns and preferably about 30 to about 40 microns. Preferably, a solid crystalline alloy is formed with grains of a size less than about 1000 nm (nanometers), desirably in a range of about 20 nm to about 500 nm, and preferably about 50 nm to about 200 nm.

After melt spinning, the alloy ribbon is comminuted to form particles thereof, each having a maximum cross-dimension or diameter less than about 45 microns and preferably less than (<) about 25 to about 30 microns.

The comminuting to form particles is easily accomplished using conventional ball-milling methods such as described by B. M. Clemens in U.S. Pat. No. 4,778,542. Alternatively, for larger particle sizes (i.e. 45 microns, −325 mesh), grinding with motor and pestle is suitable for small quantities.

After comminuting, the particles are nitrified in a non-oxidizing nitrogen-containing environment for a time and at a temperature sufficient to cause nitrogen to penetrate and occupy interstitial sites in the particles of the solid crystalline alloy.

Preferably, the step of nitrifying is conducted at a temperature of about 420° C. to about 480° C. for a time of about 4 to about 16 hours.

Gaseous nitrogen ($N_2$) was used for nitrifying at a pressure of about 5 pounds per square inch gage. Other nitrogen-containing constituents such as ammonia may be used; however, absorption of hydrogen may occur to some degree.

In a preferred method, the particles were annealed prior to nitrifying and the annealing was conducted at a temperature of about 650° C. to about 750° C. for a time of about 0.1 to about 10 hours in the non-oxidizing environment of a near absolute vacuum.

In a preferred method, the step of quenching produces ribbons with a crystalline microstructure, and then the ribbons are annealed prior to nitriding. Alternatively, the ribbons may be quenched to an amorphous alloy and then heated to form the crystalline alloy having the grain sizes described above. The heating to form the crystalline structure simultaneously anneals the ribbons. The comminuting of the ribbons may occur before or after the ribbons are heated. The crystalline structure must be formed prior to nitrifying.

The Sm-Fe-N compositions of the invention exhibit strong magnetic properties. Such properties are designated by symbols such as $H_{ci}$ and $4\pi M_s$. As used herein, H refers to the strength of an applied magnetic field; $H_{ci}$ is the intrinsic coercive force or reverse field required to bring a magnetized sample having magnetization M back to zero magnetization; M is the magnetization of a sample in electromagnetic units; $M_s$ is the saturation magnetization or the maximum magnetization that can be induced in a sample by an applied magnetic field; B is the magnetic induction or magnetic flux density of a sample where $B=H+4\pi M$, where B, M and H are in units of Gauss or Oersteds; $B_r$ is the remanent magnetic induction; BH is the energy product; and T is temperature in degrees Kelvin unless otherwise indicated. The terms "hard magnet" and "magnetically hard alloy" herein refer to compositions having intrinsic coercivities of at least about 1,000 Oersteds.

EXAMPLE 1

In this example, pure elemental Sm and Fe were weighed out to give a nominal starting ratio of Sm to Fe of 15:85 ($Sm_{15}Fe_{85}$) equivalent to 1:5.7 Sm:Fe. This composition was enriched in Sm compared to the final ribbon composition containing the samarium and iron. The essentially pure elemental ingots were induction melted to form a molten alloy of Sm-Fe. When the molten alloy reached a temperature of about 1500° C. to 1650° C., it was ejected under pressure of argon (Ar) gas through a 0.65 mm orifice onto the quench wheel. During the melt-spun process, the wheel velocity ($V_s$) was about 35 m/s producing ribbons having a thickness of less than about 40 microns. Due to the high vapor pressure of Sm at elevated temperatures, some of the Sm was lost during the induction melting and melt spinning, thus the final ribbon composition had an Sm:Fe ratio of about 14.5:85.5 Sm:Fe. This was somewhat lower in Sm than the nominal starting stoichiometry of $Sm_{15}Fe_{85}$.

The melt-spun ribbons were crushed with a mortar and pestle until the powder passed through a 325 mesh screen to obtain less than 45 micron (μm) particle size. The powder was placed in a quartz tube, which was then evacuated, backfilled with $N_2$ gas, and placed in a furnace at about 475° C. to about 480° C.

The hysteresis loop of the powder after nitriding for four hours in $N_2$ gas, FIG. 1, showed a magnetically hard powder with $H_{ci}=15.3$ kOe. The shape of the loop (solid curve) was characteristic of a material composed of a mixture of two magnetic components, suggesting that considerably higher coercivities are possible if the fraction of the high coercivity component can be increased.

High coercivities were generated in the $Sm_2Fe_{17}N_x$-based powdered ribbons, as shown by the demagnetization curves for Example 1 in FIG. 1. The as-quenched Sm-Fe ribbons (dashed curve) have a low coercivity consistent with the predominance of magnetically soft $Sm_2Fe_{17}$ in the sample. After nitriding at 475° C. for four hours (solid curve), the sample exhibits $H_{ci}=15.3$ kOe. The step in the demagnetization curve near zero field is attributed to the magnetically soft α-Fe. The shape of the demagnetization curve, with an extended tail into the third quadrant, demonstrates that the value of $H_{ci}$ is determined by the volume fraction of low coercivity phases. It is encouraging that no knee is observed in the curve even in the third quadrant at an applied field of −19 kOe, indicating substantial room for improvement in the coercivity.

Advantageously, $4\pi M_s$ for the Sm-Fe-N composition of the invention is 15.4 kG, not far from that of $Nd_2Fe_{14}B(4\pi M_s=16.1$ kG), while its values of $T_c=470°$ C. and $H_A=140$ kG are larger than for $Nd_2Fe_{14}B(T_c=315°$ C. and $H_A=80$ kG).

EXAMPLE 2

In this example, ribbons were formed by the method of Example 1, and then the ribbons were milled to a very fine powder, less than 500 mesh (less than about 25 to about 30 microns). To expedite the milling, a high speed ball mill (HSBM) was used in a method as described by B. M. Clemens, U.S. Pat. No. 4,778,542. A model 8000 HSBM mill manufactured by SPEX Corporation was used. The ball milling was performed in a closed vessel containing: 3 to 6 grams of crushed ribbons, 1 to 2 cc of perfluorohexane performance fluid PF-5060 manufactured by 3M, and three steel balls, two small balls (about 1 gram) and one large ball (about 8 grams). The PF-5060 fluid was used to displace air and provide a non-oxidizing environment for the milling. The milling was accomplished in 3 to 10 minutes. The particles formed from the comminuted ribbons were annealed for one hour in a near absolute vacuum at 700° C. This annealing also served to convert any amorphous microstructures to crystalline microstructures. During annealing, the quartz annealing tube became coated with a thick dark film, presumably a samarium-rich iron material. The temperature of the oven was then lowered to 450° C., and after the lower temperature stabilized, the vacuum environment was replaced by nitrogen gas at a pressure of 5 psig. The particles were held at 450° C. in the nitrogen atmosphere for up to several hours.

Figure 2:
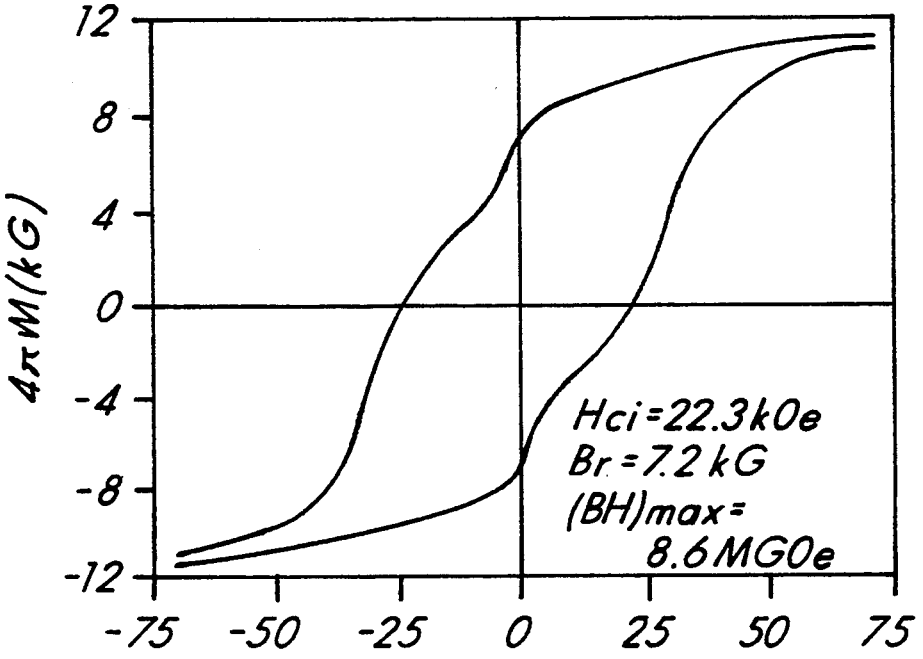
FIG. 2 is a demagnetization curve for Sm-Fe-N, −500 mesh, powder of Example 2.

Particles of the finely-powdered ribbon (less than about 25 to about 30 microns or less), when heat treated (annealed) at about 700° C. prior to nitriding as per Example 2, have enhanced coercivities. Demagnetization curves for the particles of Example 2 are shown in FIG. 2 and are characterized by a coercivity of 22 to 23 kOe. This is significantly better than the 15.3 kOe obtained by Example 1.

We expect that a range of temperatures near 700° C. will produce enhanced coercivities and that the optimum duration of high-temperature annealing might range from a few minutes to a few hours.

All of the samples analyzed were magnetized with a 120 kOe pulsed field. Magnetic measurements were performed using a P A R Model 155 vibrating sample magnetometer and either an electromagnet with a maximum applied field of 19 kOe or a 90 kOe field superconducting magnet.

Figure 3:
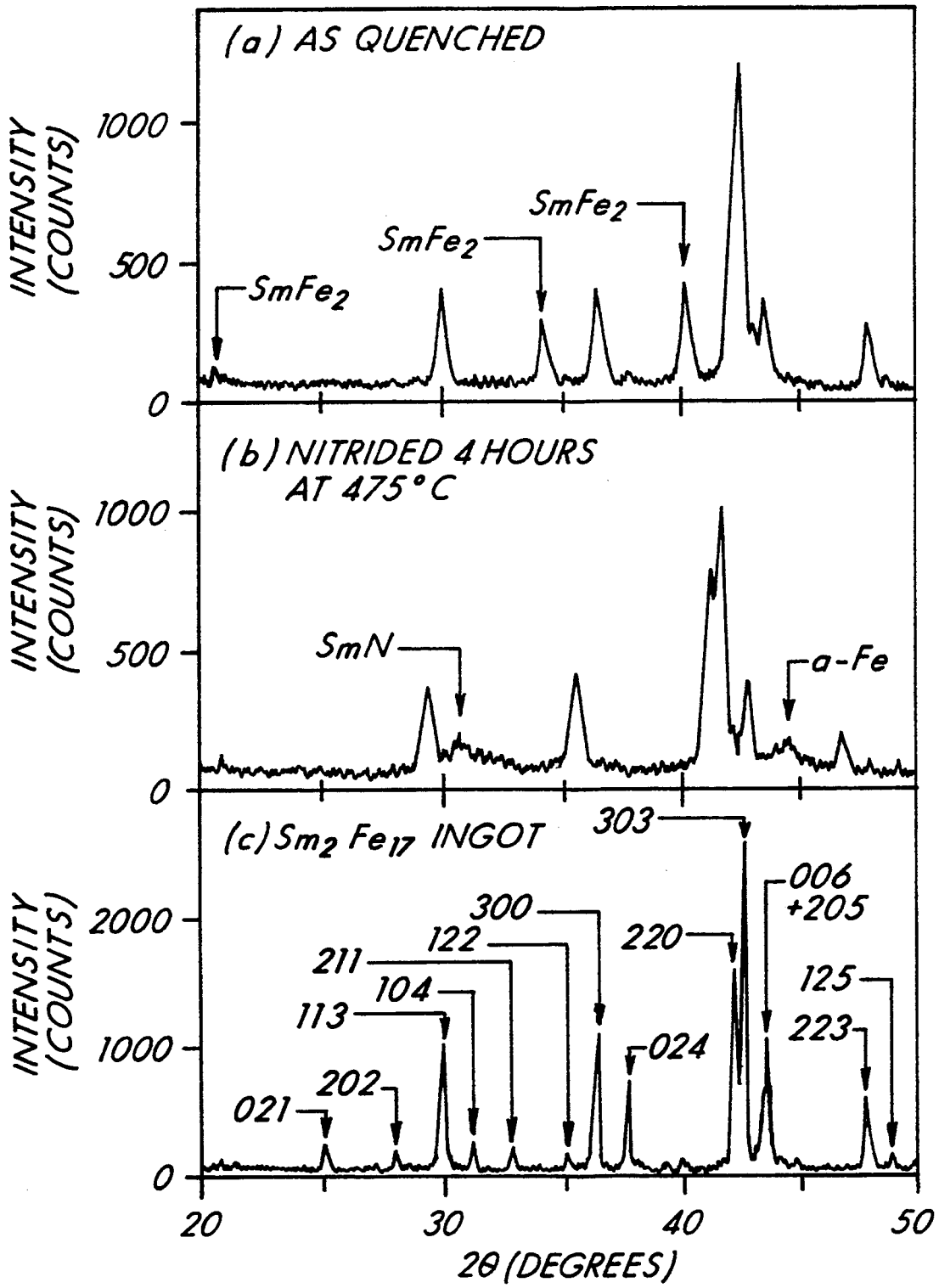
FIG. 3(*a*) shows x-ray spectra for Sm-Fe powder prepared from as-quenched Sm-Fe ribbons comminuted to −325 mesh.

The effects of nitrogen on the composition and crystal structure of melt-spun Sm-Fe ribbons are revealed by the x-ray diffraction patterns in FIG. 3. The powder x-ray diffraction pattern from an annealed ingot of $Sm_2Fe_{17}$ (a=8.548 Å, c=12.435 Å) is included in FIG. 3(*c*) for comparison. Interestingly, the as-quenched Sm-Fe ribbons shown in FIG. 3(*a*) are crystalline, whereas the wheel speed used ($v_s=35$ m/s) would produce largely amorphous Nd-Fe-B ribbons.

The diffraction pattern of FIG. 3(*a*) closely resembles that of rhombohedral $Sm_2Fe_{17}N_x$. However, the absence of a number of diffraction peaks usually present in $Sm_2Fe_{17}$ and pure $Sm_2Fe_{17}N_x$ suggests that the powders may have a different crystal structure than the $Sm_2Fe_{17}N_x$. Although the major diffraction peaks correspond to the most intense peaks of $Sm_2Fe_{17}$ (having the rhombohedral $Th_2Zn_{17}$ structure), we observed that a series of less intense $Sm_2Fe_{17}$ peaks is missing from the melt-spun material both before (3(*a*)) and after (3(*b*)) nitriding, most notably the 024 peak. The diffraction pattern can therefore also be indexed as the rare earth-rich disordered hexagonal $SmFe_7$ having the $TbCu_7$ structure, rather than the true $Th_2Zn_{17}$ structure.

The hexagonal $SmCo_5$ structure is also possible. However, $SmFe_5$ is not thought to be a stable Sm-Fe compound. Cubic $SmFe_2$ is present in the as-quenched ribbon as an impurity phase. It is curious that there is no trace of the intermediate phase $SmFe_3$, amply demonstrating the non-equilibrium nature of the rapid quenching process. The diffraction line widths are broad compared to the ingot material, suggesting a fine-grained microstructure.

Upon nitriding for four hours at a temperature of 475° C., as per Example 1, the $Sm_2Fe_{17}$ peaks shift to lower angles as nitrogen diffuses into the $Sm_2Fe_{17}$ lattice to form $Sm_2Fe_{17}N_x$ (FIG. 3(*b*)). The lattice expands to a=8.74 Å, c=12.65 Å, for a volume expansion of 6.3%. Diffuse intensity appears at the diffraction angles of the most intense peaks of both SmN and α-Fe, indicating that some decomposition occurred at the nitriding temperature. The $SmFe_2$ peaks disappear.

Figure 4:
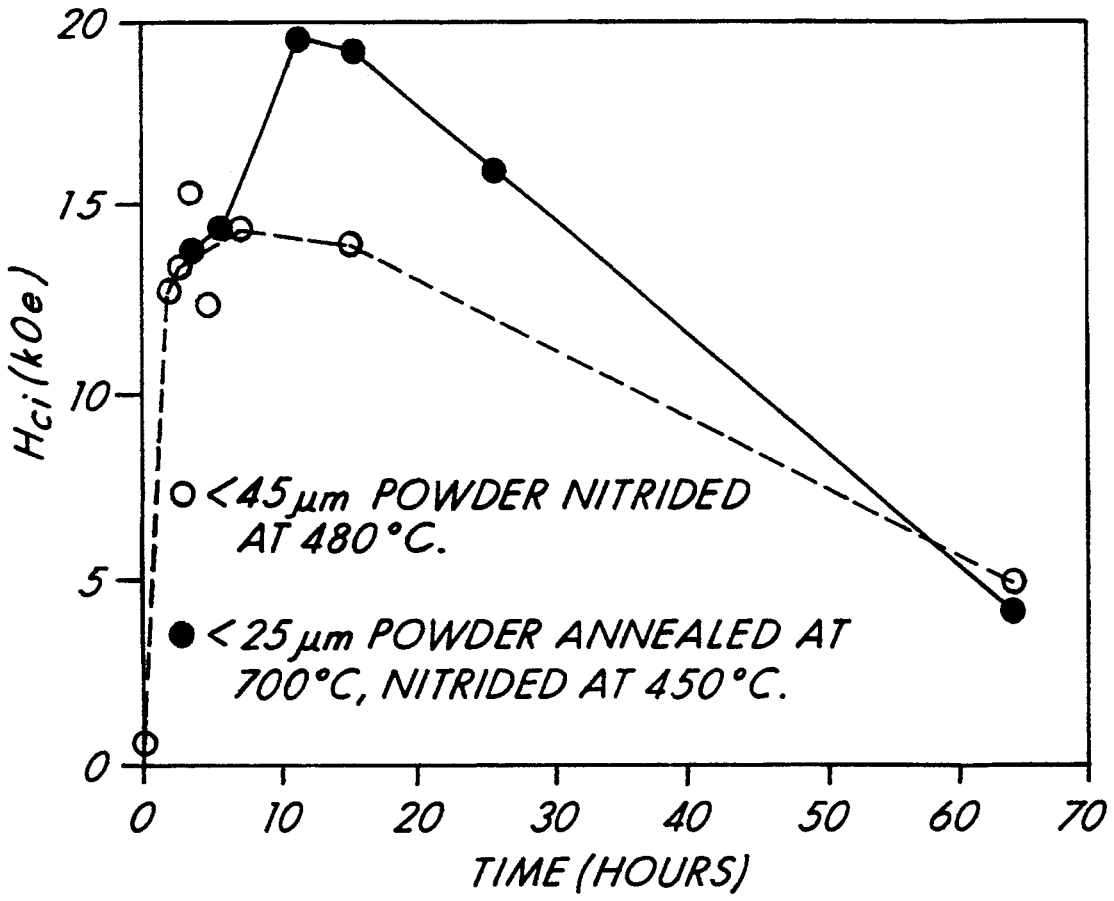
FIG. 4 shows coercivity as a function of nitriding time for nitrided, −325 mesh (<45 microns) powder (open circles) and for nitrided, annealed, −500 mesh (<25 microns) powder (closed circles).

The open circles in FIG. 4 show the effect of nitriding time at 475° C. on the coercivity of the ribbons powdered to <45 μm (−325 mesh). Maximum coercivity is achieved with nitriding times between 4 and 16 hours.

While the intent of creating a finer powder was to make it easier for nitrogen to diffuse into the powder particles, little improvement in the magnetic properties or processing was noted compared to the <45 μm powder obtained by mortar-and-pestle grinding. The x-ray diffraction pattern of the <25 μm powder, shown in FIG. 5(*a*), does not differ significantly from that of the as-quenched ribbons, and when nitrided, the coercivity is similar to that obtained with the <45 μm powder.

A substantial improvement in the final coercivity, however, is obtained by heat treating (annealing) the −500 mesh powder in vacuum at 700° C. for one hour prior to nitriding (Example 2). The powder was then furnace cooled to 450° C., and $N_2$ gas was introduced for times ranging from 1 to 64 hours. FIG. 4 (solid circles) shows the coercivity of <25 μm (−500 mesh) powder as a function of nitriding time. Maximum $H_{ci}$ occurred at about 12 to 16 hours for this <25 micron annealed powder. Our best result to date, $H_{ci}$=23 kOe, as shown in FIG. 2, is for <25 μm ribbon powder nitrided for 19 hours at 480° C. following a high temperature annealing. Although the content of magnetically soft phases is substantially reduced compared to the sample of Example 1, these still produce a significant step in the demagnetization curve and limit the remanence ($B_r$=7.2 kG) and energy product ($(BH)_{max}$=8.6 MGOe).

The vacuum annealing alone seems to have little effect on the coercivity of <45 μm powder, thus the improved coercivities are evidently obtained only when the high temperature annealing is used in conjunction with the <25 μm powder.

Figure 5:
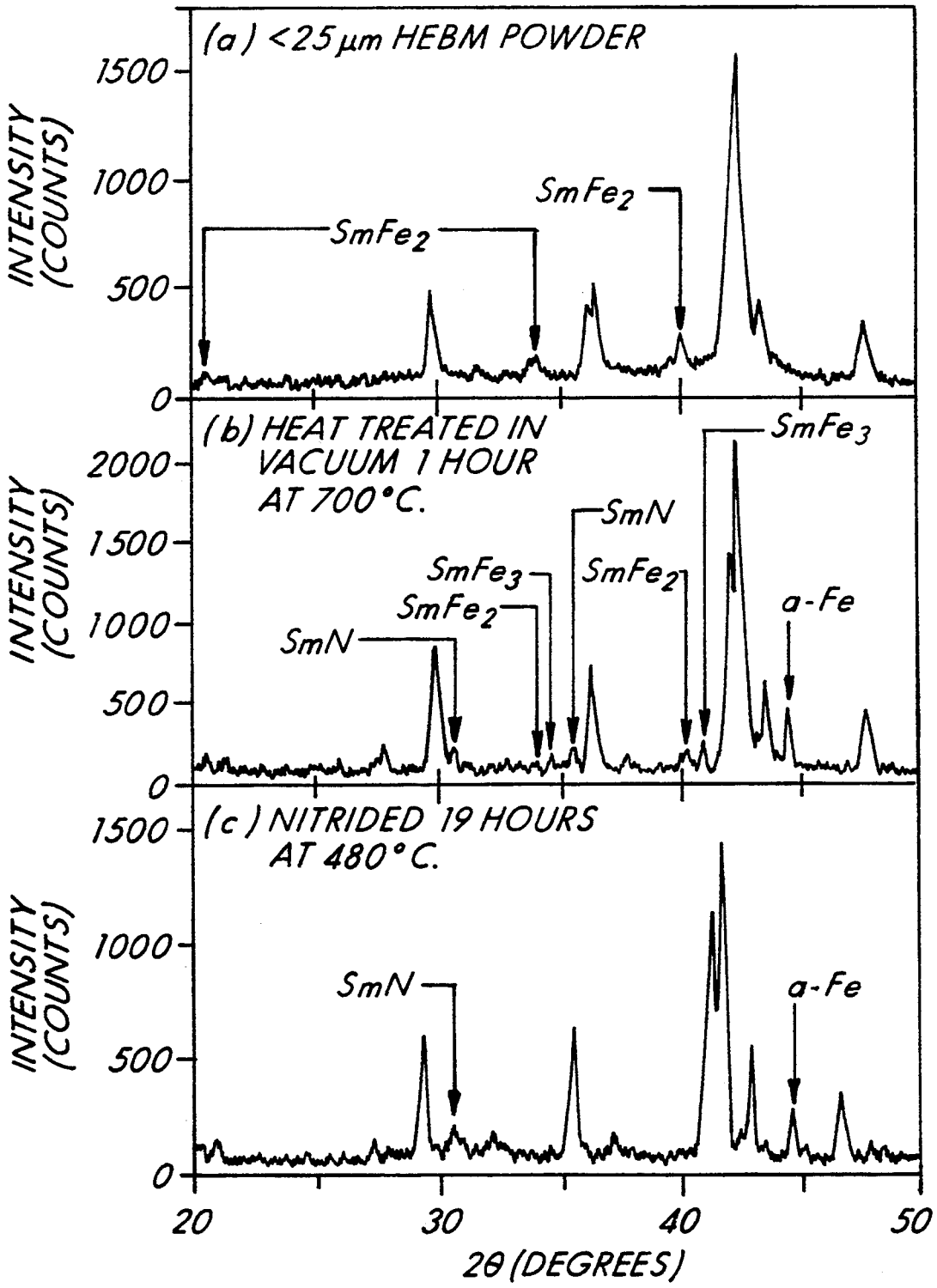
FIG. 5(*a*) shows x-ray spectra for Sm-Fe powder prepared from as-quenched Sm-Fe ribbons comminuted to −500 mesh.

FIG. 5(*b*) shows the effect of the high temperature annealing on the x-ray diffraction pattern. Aside from a narrowing of the x-ray peaks, indicating some grain growth, the $SmFe_2$ is partially converted to $SmFe_3$. Also note that some α-Fe and SmN formed during the heat treatment. The presence of SmN was surprising, since $N_2$ had not yet been introduced and the annealing was done under high vacuum conditions. The origin of the nitrogen is not yet understood. Finally, some of the minor $Sm_2Fe_{17}$ peaks which were previously missing, for example the 024, emerged. These peaks are still only a fraction of the intensity expected for isotropic $Sm_2Fe_{17}$. Upon nitriding (FIG. 5(*c*)), the x-ray pattern looked very similar to that previously obtained for the sample without annealing except, again, for some indication of the 024 $Sm_2Fe_{17}$ peak.

We have described preferred values and ranges of parameters for the method of the invention. Other values and ranges may also be suitable based upon the following observations. Best results were achieved with particle sizes less than about 25 microns (−500 mesh); at a 45 micron size, results were not as good. There may exist a level of particle size between 25 and 45 microns, for example, 30 or 40 microns, which would produce results similar to the 25 micron size. Annealing prior to nitriding was tested at 600° C. and 800° C., but results were not as good as when a range of 650° C. to 750° C. was used. In the step of nitriding, the rate of nitrogen uptake was found to be generally dependent on temperature. However, results were not as good when nitriding occurred at above 500° C. to 550° C. Lower temperatures are not a problem except that the time for nitrogen uptake is greatly extended. At a range of 425° C. to 475° C., nitriding for 4 to 16 hours produced best results. The pressure of nitriding is not critical but may somewhat affect the rate of nitrogen uptake. Thus conveniently, low pressure such as 5 psig, is suitable. Mixtures such as nitrogen and argon may also be used.

In summary, we have obtained coercivities in excess of 20 kOe in the Sm-Fe-N system by nitriding melt-spun ribbons comprised predominantly of the $Sm_2Fe_{17}$ phase. Best results are obtained by powdering the ribbon to <25 μm and heating at 700° C. in vacuum prior to nitriding.

Although other rare earth-iron nitrides have basal-plane magnetocrystalline anisotropy, for Sm-Fe-N the anisotropy is uniaxial and large, giving it the most attractive intrinsic properties of this series for permanent magnet applications.

The $Sm_2Fe_{17}$ precursor does not have desirable magnetic properties: its Curie temperature is only 116° C. and it has planar anisotropy. Nitriding the compound by the method of the invention profoundly changes its magnetic properties, converting the anisotropy to uniaxial and substantially improving the Curie temperature, the room temperature saturation magnetization, and providing high intrinsic coercivity.

While this invention has been described in terms of certain embodiments thereof, it is not intended that it be limited to the above description, but rather only to the extent set forth in the following claims.

The embodiments of the invention in which an exclusive property or privilege is claimed are defined as follows.

1. A method of making an alloy having a nitrified $Sm_2Fe_{17}$ structure, consisting of nitrogen (N), samarium (Sm) and iron (Fe), by the steps of:

a) forming a molten alloy consisting of samarium (Sm) and iron (Fe) in an atomic ratio of about 1:4 to about 1:9 (Sm:Fe) in a non-oxidizing environment;

b) quenching the molten alloy in a non-oxidizing environment at a rate sufficient to form an alloy ribbon having a thickness less than about 200 microns, a crystalline microstructure and a grain size less than about 500 nanometers;

c) comminuting the alloy ribbon to a maximum cross-dimension thereof less than about 45 microns; and d) nitrifying the comminuted alloy ribbons in a non-oxidizing, nitrogen-containing atmosphere for a time and at a temperature sufficient to cause nitrogen to penetrate and occupy interstitial sites in the solid crystalline microstructure, and to provide the nitrified $Sm_2Fe_{17}$ structure consisting of N, Sm and Fe and characterized by an intrinsic coercivity of at least about 10,000 Oersteds at room temperature.

2. The method according to claim 1 wherein the step of nitrifying is conducted at a temperature of about 420° C. to about 480° C., for a time of about 4 to about 16 hours.

3. The method according to claim 1 wherein the step of nitrifying is conducted in the atmosphere consisting essentially of gaseous nitrogen.

4. The method according to claim 3 wherein the gaseous nitrogen is maintained at a pressure of about 5 pounds per square inch gage.

5. The method according to claim 1 wherein before step (d) the ribbons are annealed at a temperature of about 650° C. to about 750° C., for a time of about 0.1 to about 10 hours, and in a vacuum.

6. The method according to claim 1 wherein the quenching is conducted at a rate sufficient to form the grain size in a range of about 50 nanometers to about 200 nanometers and the ribbon thickness of about 20 microns to about 120 microns.

7. A method of making an alloy having a nitrified $Sm_2Fe_{17}$ structure consisting of nitrogen (N), samarium (Sm) and iron (Fe), by the steps of:

a) forming a molten alloy consisting of samarium (Sm) and iron (Fe) in an atomic ratio of about 1:4 to about 1:9 (Sm:Fe) in a non-oxidizing environment;

b) quenching the molten alloy in a non-oxidizing environment at a rate sufficient to form an alloy ribbon of an amorphous material or a crystalline material having a grain size less than about 500 nanometers, the ribbon having a thickness of less than about 200 microns;

c) comminuting the alloy ribbon to a maximum cross-dimension thereof less than about 25 microns;

d) heating the alloy ribbon in a non-oxidizing environment for a time and at a temperature sufficient to anneal the ribbon and/or to produce a crystalline microstructure and a grain size less than about 500 nanometers; and then e) nitrifying the alloy ribbon in a non-oxidizing, nitrogen-containing atmosphere for a time and at a temperature sufficient to cause nitrogen to penetrate and occupy interstitial sites in the solid crystalline microstructure, and to provide the nitrified $Sm_2Fe_{17}$ structure consisting of N, Sm and Fe and characterized by an intrinsic coercivity of at least about 20,000 Oersteds at room temperature.

8. The method according to claim 7 wherein step (d) is conducted at a temperature of about 650° C. to about 750° C., for a time of about 0.1 to about 10 hours, and in a vacuum.

9. The method according to claim 7 wherein the step of nitrifying is conducted at a temperature of about 420° C. to about 480° C., for a time of about 4 to about 16 hours.

10. The method according to claim 7 wherein the step of nitrifying is conducted in the atmosphere consisting essentially of gaseous nitrogen.

11. The method according to claim 10 wherein the gaseous nitrogen is maintained at a pressure of about 5 pounds per square inch gage.

12. The method according to claim 7 wherein the quenching is conducted at a rate sufficient to form the grain size in a range of about 50 nanometers to about 200 nanometers and the ribbon thickness of about 20 microns to about 120 microns.

* * * * *